US007712232B2

(12) United States Patent
Majkrzak

(10) Patent No.: US 7,712,232 B2
(45) Date of Patent: May 11, 2010

(54) CONCENTRIC AXIS SNOW BLOWER ATTACHMENT

(76) Inventor: David S. Majkrzak, 528 Kingston Pl., West Fargo, ND (US) 58078

( * ) Notice: Subject to any disclaimer, the term of this patent is extended or adjusted under 35 U.S.C. 154(b) by 822 days.

(21) Appl. No.: 11/230,214

(22) Filed: Sep. 19, 2005

(65) Prior Publication Data

US 2007/0062076 A1 Mar. 22, 2007

(51) Int. Cl.
*E01H 5/09* (2006.01)

(52) U.S. Cl. ..... 37/252; 37/245; 37/267; 37/249

(58) Field of Classification Search ..... 37/245, 37/251, 261, 236, 257, 258, 248, 249, 252, 37/259, 260–262
See application file for complete search history.

(56) References Cited

U.S. PATENT DOCUMENTS

| | | | | |
|---|---|---|---|---|
| 2,109,393 | A | 6/1935 | Bleu | |
| 2,200,623 | A * | 5/1940 | James | 37/252 |
| 2,269,326 | A | 1/1942 | Wandscheer | |
| 2,882,620 | A | 4/1959 | Macdonald | |
| 3,115,715 | A | 12/1963 | Baldwin | |
| 3,140,768 | A | 7/1964 | Marr | |
| 3,230,645 | A * | 1/1966 | Lutz | 37/242 |
| 3,305,949 | A * | 2/1967 | Holley | 37/213 |
| 3,321,851 | A * | 5/1967 | Fisher | 37/233 |
| 3,395,466 | A | 8/1968 | Klapprodt | |
| 3,464,128 | A | 9/1969 | Krickovich | |
| 3,490,057 | A | 1/1970 | Kahlbacher | |
| 3,583,084 | A * | 6/1971 | Farrell | 37/245 |
| 3,755,931 | A | 9/1973 | Gisler | |
| 3,766,586 | A * | 10/1973 | Krickovich | 15/83 |
| 3,886,675 | A * | 6/1975 | Maisonneuve et al. | 37/211 |
| 4,359,831 | A * | 11/1982 | Beeley | 37/258 |
| 4,367,603 | A | 1/1983 | Schlapman | |
| 4,385,457 | A | 5/1983 | Fralish | |
| 4,391,052 | A | 7/1983 | Guy, Jr. | |
| 4,477,989 | A | 10/1984 | Vachon | |
| 4,480,397 | A | 11/1984 | Vachon | |
| 4,651,452 | A * | 3/1987 | Husso | 37/225 |
| 5,209,003 | A * | 5/1993 | Maxfield et al. | 37/252 |
| 5,346,018 | A * | 9/1994 | Koster | 172/47 |
| 5,802,745 | A * | 9/1998 | Haseotes et al. | 37/234 |
| 6,266,598 | B1 * | 7/2001 | Pillar et al. | 701/54 |
| 6,705,028 | B2 * | 3/2004 | Hanafusa et al. | 37/246 |
| 6,810,609 | B2 * | 11/2004 | Lassonde et al. | 37/236 |

FOREIGN PATENT DOCUMENTS

JP 10096219 A * 4/1998

* cited by examiner

*Primary Examiner*—Thomas A Beach
(74) *Attorney, Agent, or Firm*—Patterson, Thuente, Skaar & Christensen, P.A.

(57) ABSTRACT

A snow blower attachment includes a concentric axis fan and auger, the fan and auger being independently powered by respective motors and being axially operably coupled for support and for independent rotation of the fan and auger.

22 Claims, 11 Drawing Sheets

CONCENTRIC AXIS SNOW BLOWER ATTACHMENT

TECHNICAL FIELD

The present invention is a snow blower attachment adapted to be attached to a powering vehicle. More particularly, the snow blower attachment of the present invention is adapted to be mounted on a skid steer vehicle, a compact tractor, or the like.

BACKGROUND OF THE INVENTION

Skid steer vehicles and other vehicles having similar function typically have a number of attachments that may be mounted on the vehicle for performing a variety of tasks. Unlike tractors, which typically have attachments mounted on the rear of the tractor, skid steer type vehicles typically have the attachment mounted on the front of the vehicle where it is much more convenient for the operator sitting in a cab to view the working attachment in front of him.

In the past, snow blower attachments have been mounted on skid steer type vehicles. In most cases, the snow blower attachments were originally designed to be mounted at the rear of a tractor. The method of mounting at the rear of a tractor is known as a three point hitch, having two lower links that are spaced apart and generally oriented in a V shape and an upper, centrally disposed link. The links are typically two to three feet in length. A three point hitch necessarily spaces the attachment significantly rearward of the tractor. When such attachments are adapted for use with skid steer type vehicles, the adaptation of the three point hitch necessarily places the attachment well in front of the skid steer type vehicle. Such placement impairs the ability of the operator to see immediately in front of the attachment and makes the skid steer vehicle and attachment as a unit unduly long, thereby impairing operation in close quarters.

Typically, snow blowers have a transverse auger. The auger may have opposed flighting on either side of the center point of the auger. Rotation of the auger then tends to pull the snow toward the center of the auger. A large fan is typically mounted behind the auger. The axis of the fan is typically orthogonally disposed with respect to the axis of the auger. The fan, being a rather large diameter increases the height the of the snow blower attachment, thereby further impairing the ability of the operator in a skid steer type vehicle to see immediately in front of the snow blower attachment.

Further, with a centrally mounted fan, the chute through which the snow is ejected is usually positioned immediately above the large fan housing in the center of the snow blower attachment. Such disposition of the chute again further impairs the ability of the operator in the cab of the skid steer type vehicle or other vehicle to view objects that may be in the front of the snow blower attachment.

Accordingly, there is a need in the industry for a snow blower attachment for attaching to skid steer type vehicles and other vehicles that is mounted close to the vehicle and is compact in size with minimal height in order to minimize the impairment of the operator's vision forward of the snow blower attachment.

SUMMARY OF THE INVENTION

The concentric axis snow blower attachment of the present invention substantially meets the aforementioned needs of the industry. The chassis assembly of the snow blower attachment includes "quik-tach" plates mounted directly on the chassis. Such plates permit the snow blower attachment to be quickly and easily mounted directly to the lifting arms of the skid steer type vehicle, thereby minimizing the forward projection of the snow blower attachment relative to the skid steer type vehicle. No attaching points normally associated with three point hitch links are included. As noted above, such attaching points typically act to undesirably extend the snow blower attachment from the vehicle. It should be noted however, that, where desired, the snow blower attachment of the present invention could readily be modified for use with three point hitch links.

While snow blowers having the fan and auger mounted on a single axis are known, they typically power both the fan and the auger from a single source. The source in the past has usually been a PTO shaft and gearing was used to drive the fan and auger at different speeds. While the speeds of rotation were different, both the fan and the auger were dependent on the single motive source. The present invention advantageously independently drives the fan and the auger and concentrically axially mounts the fan and auger.

Further, the auger and the fan of the snow blower attachment are concentric axially disposed. Such disposition minimizes the height of the snow blower attachment over which the operator must sight in order to see in front of the snow blower attachment. Additionally, the fan is at one end of the auger. This places the chute assembly close to an end margin of the snow blower attachment. Accordingly, the chute assembly is to the side of the field of view necessary for the operator in the cab of the skid steer type vehicle to view in front of the snow blower attachment.

Other efficiencies are apparent in the design for the concentric axis snow blower attachment of the present invention. The chute assembly is rotatable through approximately 270° to allow the snow to be discharged back down along the right side of the skid steer type vehicle or transversely across the front of the skid steer type vehicle. Further, a rounded inlet wall directs the snow to be ejected from the fan blades through the round chute assembly. The transition is from round inlet to round chute as opposed to square inlet to round opening to square chute typically in prior art snow blowers. The prior art configuration is much more prone to plugging. The configuration of the present invention minimizes the possibility of moist, heavy snow packing and jamming the chute assembly. The noted configuration of the present invention further keeps the chute low, preferably at about a 45 degree angle relative to the top of the snow blower attachment body, advantageously minimizing the discharge path of the blown snow The hub of the auger is formed of a tube having a significant diameter, on the order of 40 percent of the diameter of the auger flighting. The relatively large hub tends to control the amount of snow that is admitted into the snow blower attachment for discharge therefrom and advantageously strengthens the auger. This further minimizes the possibility of jamming the snow blower attachment with moist heavy snow.

Finally, both the auger and the fan are reversible in their directions of rotation in order to assist in the ejection of any debris that may have been caught in either the auger or the fan. In practice, a reduction of power in the reverse direction is automatically provided to minimize the possibility of auger damage when an object is jammed in the auger. Further, in either direction of rotation, hydraulic pressure in the system is automatically bled of in the event of a stoppage of either or both the fan and the auger.

The present invention is a snow blower attachment, the snow blower attachment includes a concentric axis fan and auger, the fan and auger being independently powered by respective motors and being axially operably coupled for support and for independent rotation of the fan and auger.

DETAILED DESCRIPTION OF THE DRAWINGS

Figure 1:
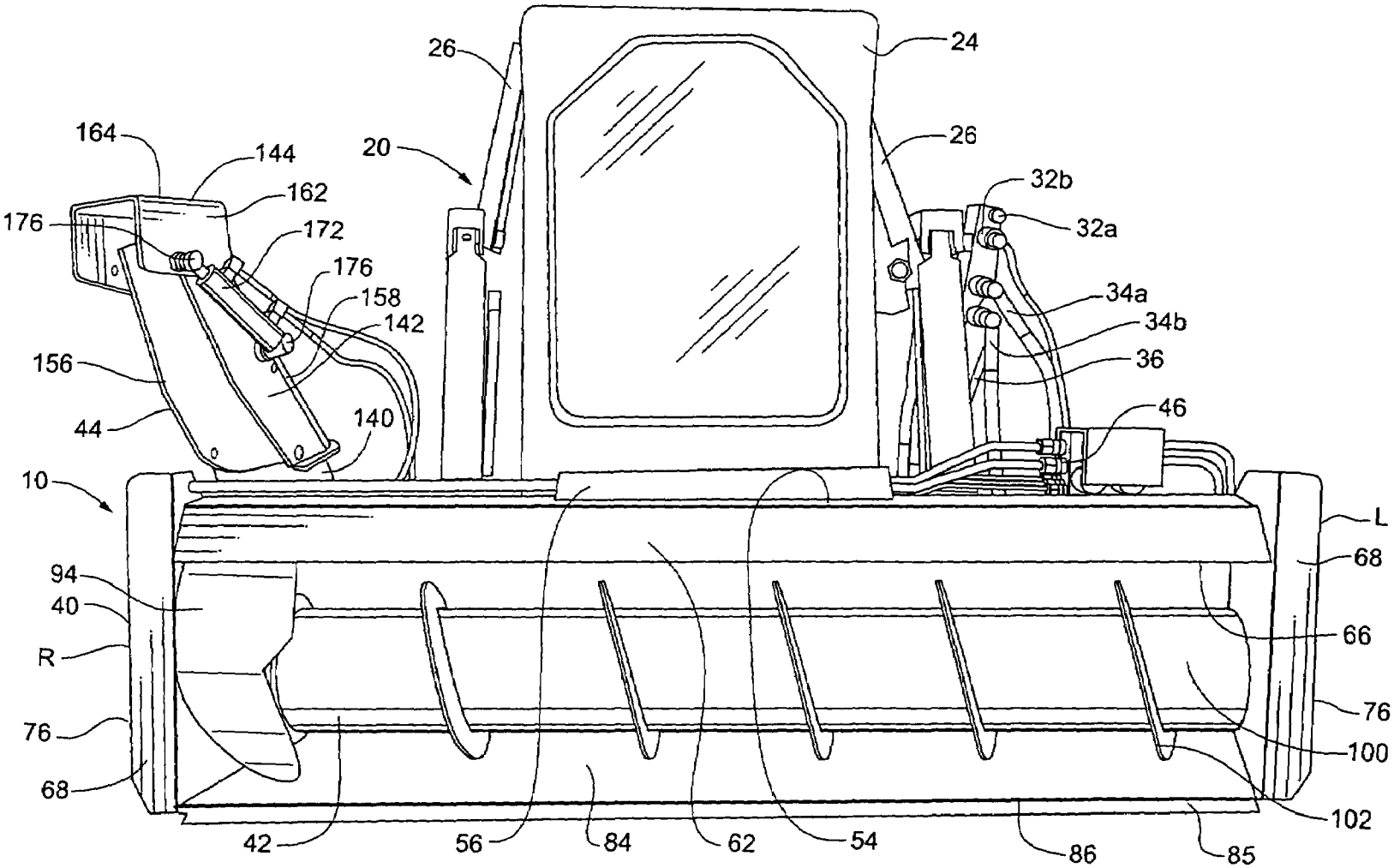
FIG. 1 is a front elevation view of the snow blower attachment mounted to a skid steer vehicle.

The concentric axis snow blower attachment of the present invention is shown generally at 10 in the figures. The snow blower attachment 10 is particularly adapted to be attached to a skid steer vehicle 20, however the snow blower attachment 10 may be used on other vehicles as well, such as compact tractors and the like.

An exemplary skid steer vehicle is shown generally at 20 in the figures. The skid steer 20 has a chassis 22 with a centrally mounted cab 24. Two lift arms 26 are included with one lift arm 26 disposed along either side the cab 24 and typically being hinged toward the rear portion of the skid steer vehicle 20.

Pivot actuators 28 are mounted to each of the lift arms 26. A pivot point 30 is disposed at the very bottom forward end of the each of the lift arms 26. Such a pivot point 30 permits an attachment (including the present attachment 10) that is coupled to the skid steer 20 to be pivoted relative to the lift arms 26, as well as being raised by the arms 26.

A certain skid steer 20 may have two different types of electrical connectors 32*a*, 32*b*. The newer type electrical connector 32 is a seven pin connector that is a connection with the computer on board the skid steer 20. Communications are typically multiplexed over the pins to thumb controls on the ends of the two motion control levers that control operation of the skid steer vehicle 20. The older type electrical connector 32 has significantly more contacts. Other skid steer vehicles may have other communication arrangements than the exemplary skid steer 20. Such arrangements are also compatible with the snow blower attachment 10.

The skid steer 20 has two hydraulic connectors 34*a*, 34*b*. The operator in the cab 24 can command either one of the hydraulic connectors 34*a*, 34*b* to be the output of high pressure hydraulic fluid. The return is then the other of the selected hydraulic connector 34*a*, 34*b* for hydraulic output. By this means, the rotation and rotational direction of both the fan and the auger are readily controlled. A smaller sump (or case) hydraulic connector 36 is also provided. In a hydraulic motor, there is always some leakage into the sump (case) of the hydraulic motor. Such hydraulic fluid is typically at significantly lower (nearly zero) pressure and may be returned to the skid steer 20 via the sump hydraulic connector 36.

The snow blower attachment 10 of the present invention has four major subcomponents: chassis assembly 40, auger/fan assembly 42, chute assembly 44, and hydraulic assembly 46.

Turning to the first subcomponent of the snow blower attachment 10, the chassis assembly 40 is preferably formed of steel plate. The chassis assembly 40 has a generally rectangular cross section with a front opening 49 for admitting snow thereto (FIGS. 1-8).

The chassis assembly 40 has a back 50 that is generally rectangular in shape. Two quik-tach plates 52 are spaced apart and fixedly mounted to the back 50. The quik-tach plates 52 selectively mate directly to cab operated hydraulic mounting devices mounted to the ends of the lift arms 26 of the skid steer vehicle 20, for hands-off attaching of the snow blower attachment 10 to skid steer 20. The quik-tach plates 52 also mount to non cab operated mounting devices that require external manual operation. The quik-tach plates 52 are known in the industry.

In an embodiment, the chassis assembly 40 has a generally rectangular top 54. A protective bridge 56 is centrally disposed on the top 54. By bridging the bridge 56, a protected space beneath the bridge 56 is defined for the passage of hydraulic tubes therethrough.

The top 54 further includes a circular outlet opening 58 disposed proximate an end margin (the right end margin, when viewed from the cab 24) of the top 54. A plurality of mounting bores 60 are defined on the top 54 for mounting a portion of the hydraulic assembly 46 to the top 54. A deflector 62 spans the full length of the top 54 and is mounted at the forward edge of the top 54 by a plurality of hinges 64. When in the depicted down position of FIGS. 1 and 2, a first portion of the deflector 62 is flush with the top 54. The deflector 62 is held in this disposition by its own weight. The leading portion of the deflector 62 is bent downwards to define a deflector lip 66. As an excessive amount of snow is ingested into the snow blower attachment 10, the deflector 62 will rise upon the snow. Such action is clearly visible to the operator and gives an indication to the operator to the skid steer vehicle 20 that the operator might want to reduce forward speed, thereby reducing snow intake and preventing the snow blower attachment 10 from being impacted with snow.

The chassis assembly 40 further includes a pair of opposed endplates 68. In an embodiment, each of the endplates 68 includes a generally square opening 70 through which respective hydraulic motors (described in greater detail below) for independently driving the auger 96 and the fan 98 are inserted. A round or other shape for the opening 70 would work equally well. A plurality of bores 72 are defined peripheral to the opening 70 for effecting the mounting of the respective hydraulic motors therein. A plurality of bolts 74 projects outward from the respective endplates 68.

The forward portion of the respective endplates 68 is comprised of a leading lip 76 that is bent outward with respect to the chassis assembly 40 for capturing a portion of the snow that lies outward of the chassis assembly 40, as the snow blower attachment 10 is advanced into the snow. A generally horizontal bumper 78 projects outward from the respective endplates 68. In practice, the bumper 78 could either be a portion of the respective endplate 68 or be the end margin of the bottom 84, discussed in greater detail below.

A cover 80 is provided with each of the endplates 68. The cover 80 is designed to provide protection to the hydraulic lines coupled to the respective hydraulic motors driving the auger and fan. Each of the covers 80 has a plurality of slots 82 defined therein for mating with the bolts 74.

The bottom 84 has a generally rectangular shape. A replaceable blade 85 is mounted at the leading edge 86 of the bottom 84.

Figure 4:
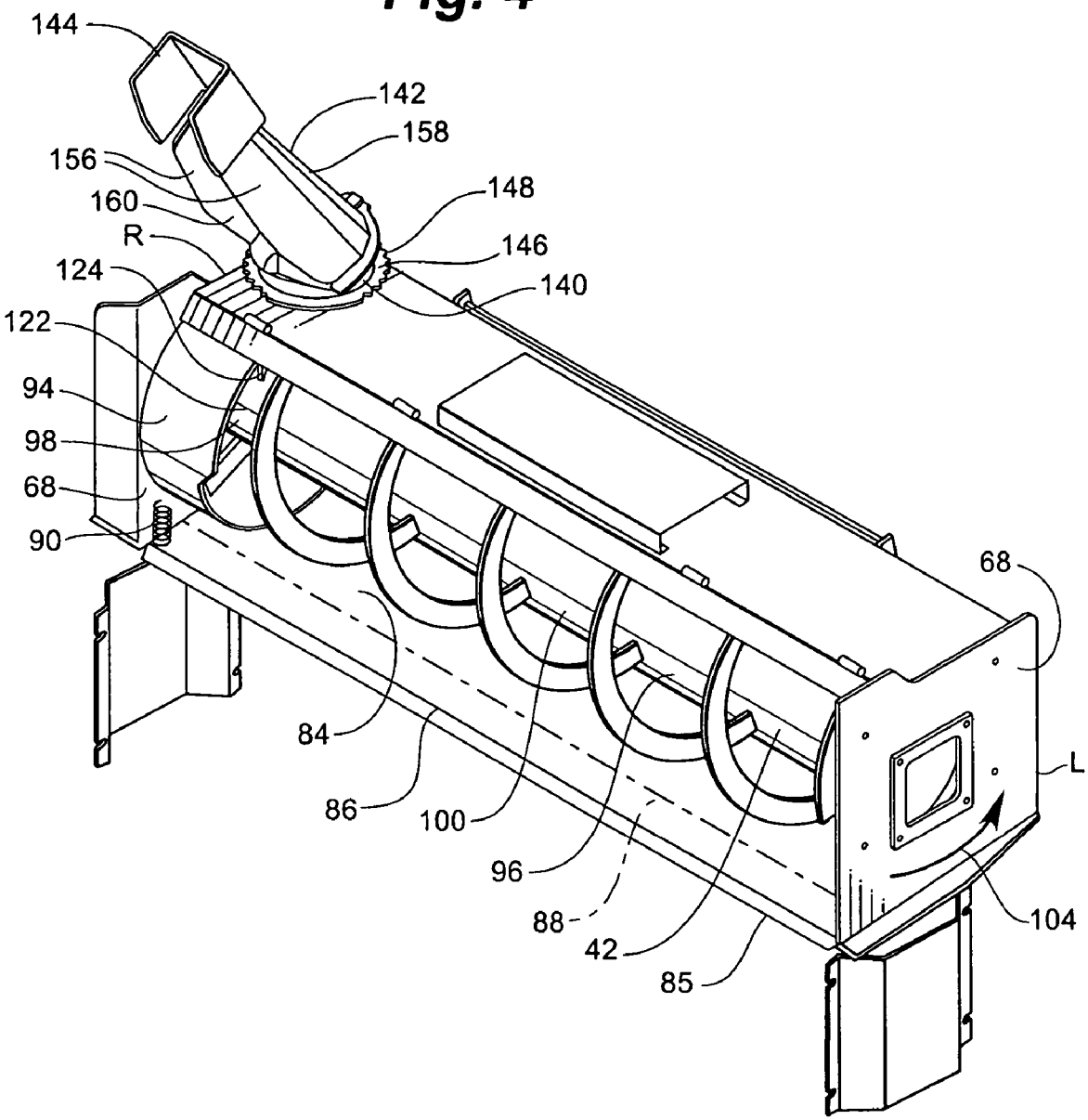
FIG. 4 is a left front perspective view of the snow blower attachment with the covers removed and no auger motor.
Figure 5:
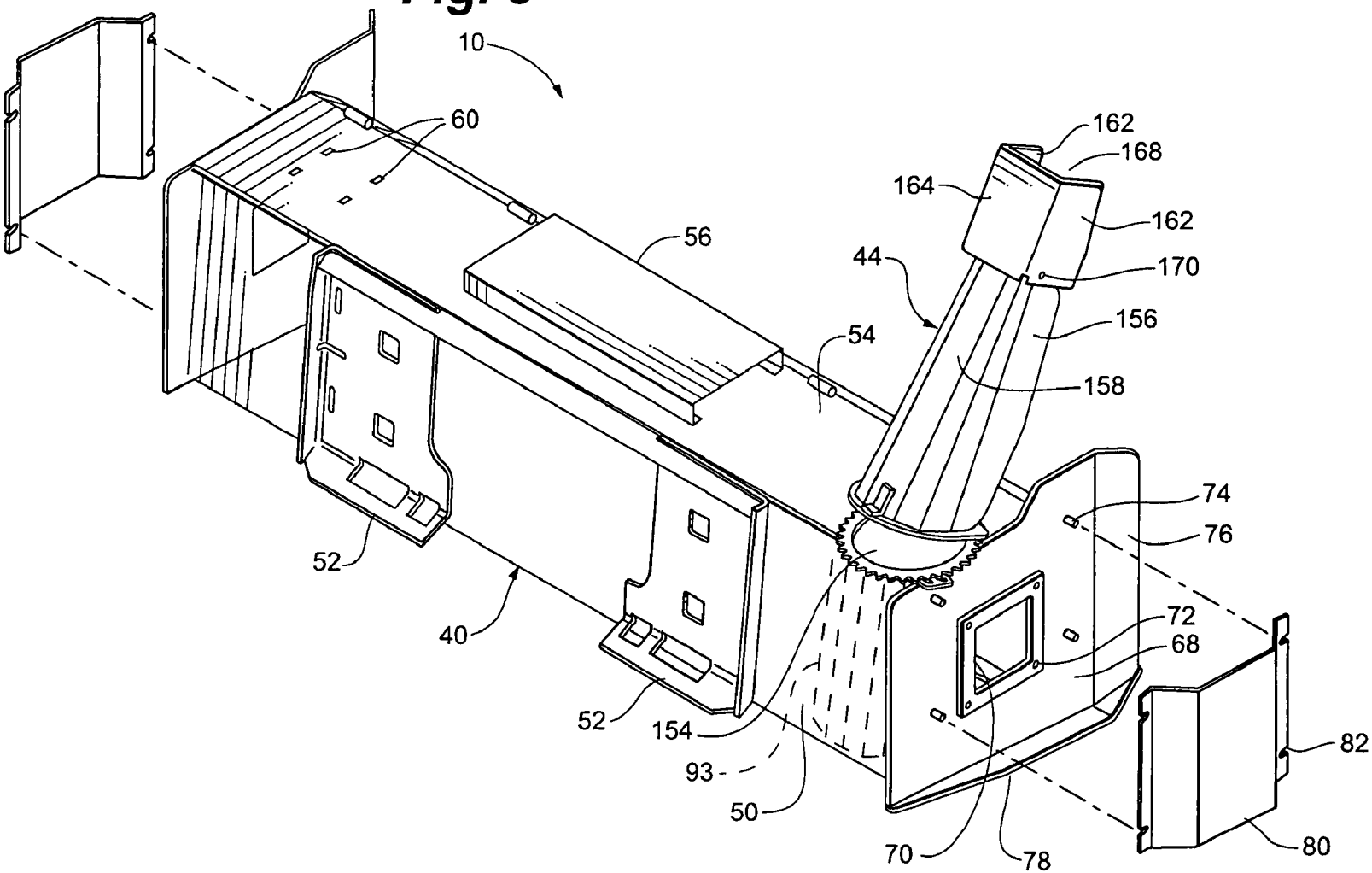
FIG. 5 is a right rear perspective view of the snow blower attachment with the covers removed.
Figure 6:
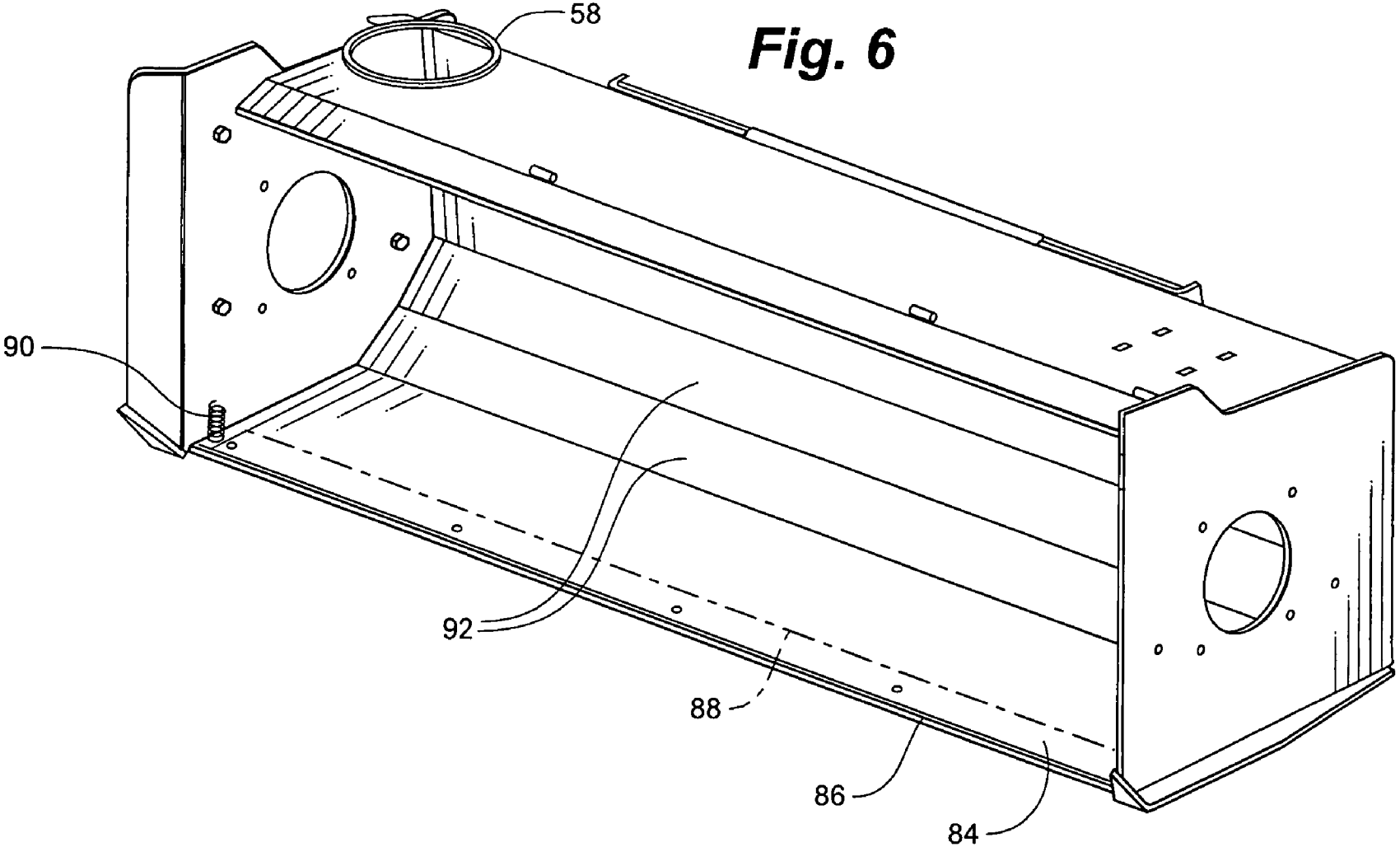
FIG. 6 is a left front perspective view of the snow blower attachment chassis assembly.
Figure 7:
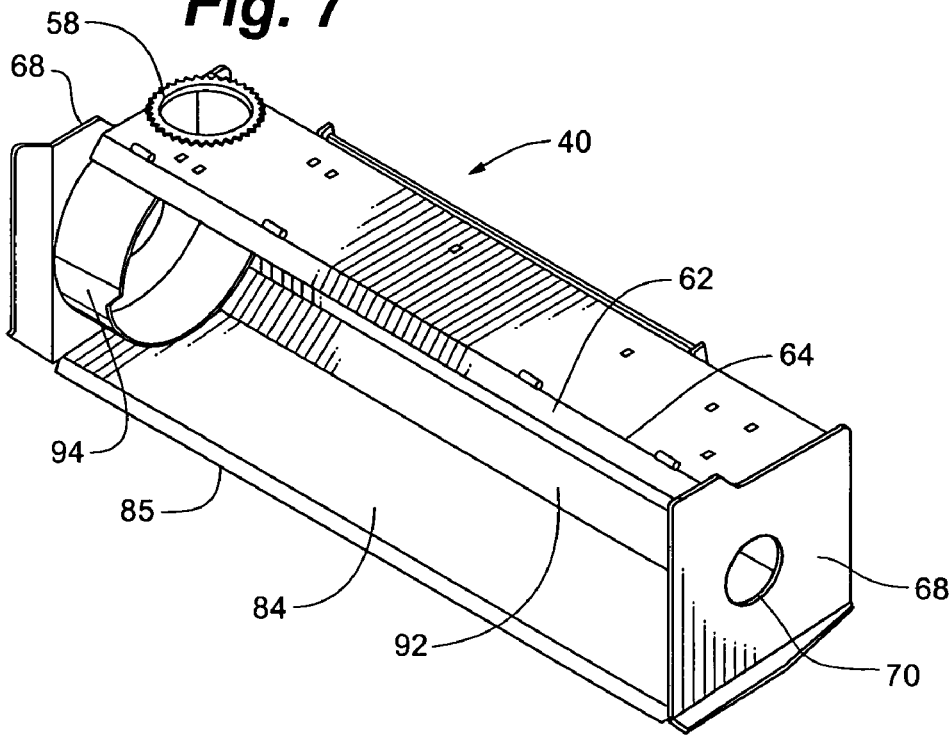
FIG. 7 is front quarter perspective of the chassis assembly of the snow blower attachment.
Figure 8:
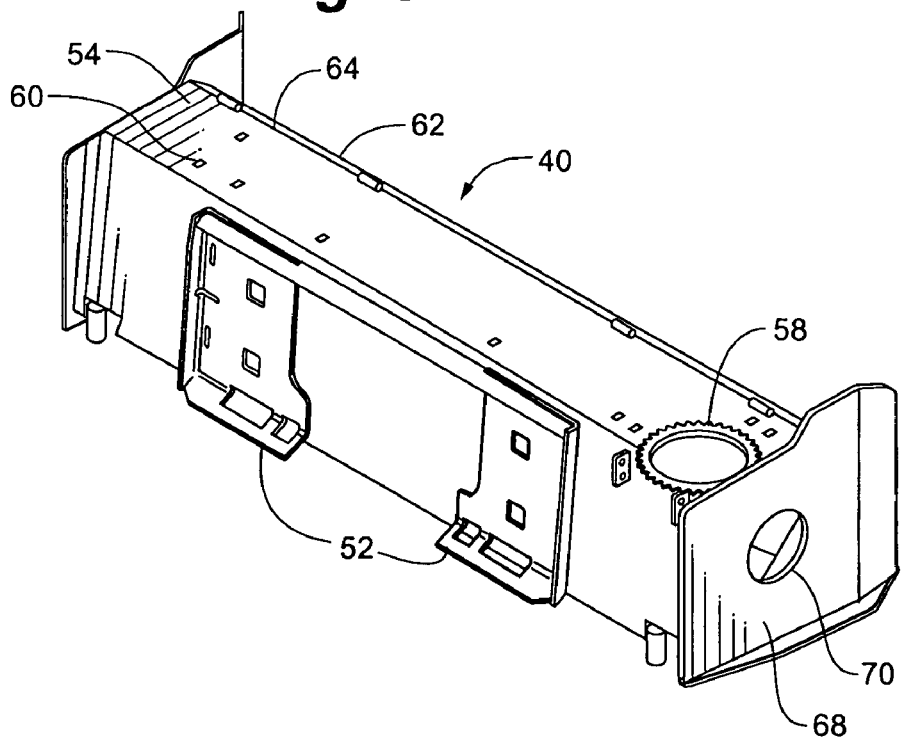
FIG. 8 is rear quarter perspective of the chassis assembly of the snow blower attachment.

In the embodiment of FIG. 4, the blade 85, and leading edge 86 are optionally hinged to the forward portion of the bottom 84 by a hinge 88. A spring 90 at either side margin of the bottom 84 (the right spring 90 being depicted) is coupled at one end to the respective endplates 68 and at the other end to the hinged blade 85 and leading edge 86. When an obstruction, such as a sewer casing or the like, is impacted by the snow blower attachment 10, the blade 85 and leading edge 86 rotate downward about the hinge 88, thereby minimizing damage to the blade 85. Further, this prevents a jarring impact to the snow blower attachment 10 and the skid steer 20, as well as to the operator. When the obstruction is passed, the hinged blade 85 and leading edge 86 is resettable and may be brought back into the depicted flush disposition by the springs 90 and/or in conjunction with backing motion of the skid steer vehicle 20.

Preferably, a plurality of rounding facets 92 are welded proximate the juncture of the back 50 and the bottom 84 to conform more closely to the outside diameter of the flighting of the auger 96. Preferably, a plurality of generally upright rounding facets 95 are welded proximate the juncture of the back 50 and the right end plate 68 (see FIG. 5) to provide a rounded inlet for the snow being forced upward to the chute assembly 44 by the fan 98. A generally semi-circular fan shroud 94 is disposed at the right side of the chassis assembly 40 spanning the distance between the top 54 and the bottom 84.

The second subcomponent of the snow blower attachment 10 is the auger/fan assembly 42. The auger/fan assembly 42 includes the auger 96 and a fan 98. It should be understood that the greater portion of the work performed in blowing snow is performed by the fan 98 as compared to the auger 96, particularly if the it is sought to propel the snow great distances from the snow blower attachment 10. Accordingly, it is desirable that the fan 98 rotate at a considerably greater speed than the auger 96. Although the auger 96 and the fan 98 are concentric axially mounted they are independently driven by two hydraulic motors, one motor 106 dedicated to driving the auger 96 and the other motor 126 dedicated to driving the fan 98. The fact that the auger 96 and fan 98 are concentric axially mounted, yet independently driven, is one of the features that sets the snow blower attachment 10 apart from the prior art.

The auger 96 has a tubular hub 100, preferably formed of tubular steel. The diameter of the hub 100 is chosen to be substantial in size (four to twelve inches, preferably) in order to provide a barrier to an inordinate amount of snow entering the snow blower attachment 10. By this means, the snow blower attachment 10 is much less prone to be clogged, especially by wet, heavy snow. The auger 96 is disposed well within the envelope defined by the chassis assembly 40, especially proximate the front opening 49, in order to protect the auger from damage. It is more cost effective to let the chassis assembly 40, as compared to either auger 96 or the fan 98, bear the brunt of any impacts with foreign objects.

Flighting 102 is disposed on the outer margin of the hub 100. The flighting 102 is unidirectional, as can be seen in FIGS. 1, 4, 13, and 14, in that rotation of the auger 96 in the direction of the arrow 104 of FIG. 4 tends to move snow left (L) to right (R) across the face of the snow blower attachment 10, thereby feeding the snow to the fan 98. The flighting 102 is spiral wound and spaced apart from the hub 100 and supported in this disposition by support pieces 013 that extend from the hub 100 to the flighting 102.

Generally, the hub 100 diameter is between 20 and 60 percent of the flighting 102 diameter and is more preferably 40 percent of the flighting 102 diameter. Preferably, the hub is 8 inches in diameter and the flighting is 18 inches in diameter.

Figure 15:
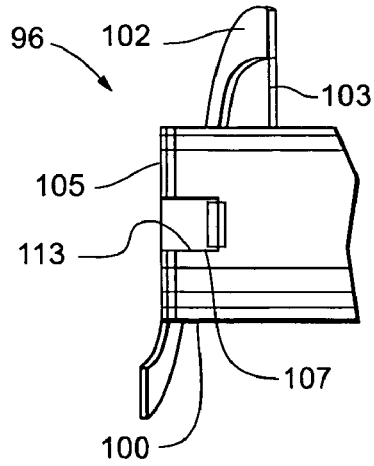
FIG. 15 is an elevational view of the right side margin of the auger.

The auger 96 has a right end plate 105, as depicted in FIG. 15. The right end plate 105 is generally co-extensive with the end margin of the hub 100. A short tubular, inward directed hub 107 is disposed at the center of the end plate 105. Hub 107 has a cylindrical inner margin 113.

Figure 12:
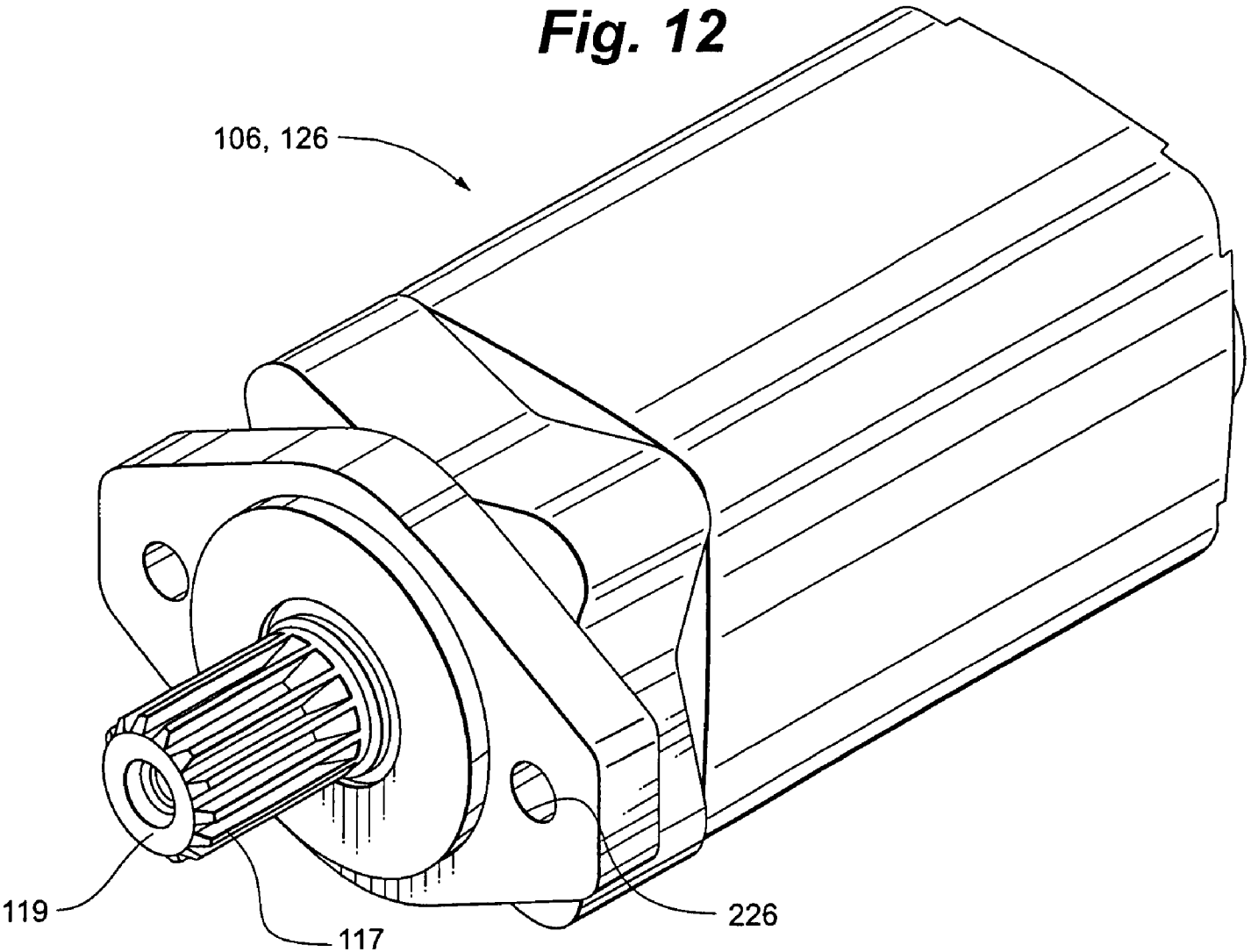
FIG. 12 is a perspective view of a hydraulic motor for driving with the fan or the auger.
Figure 13:
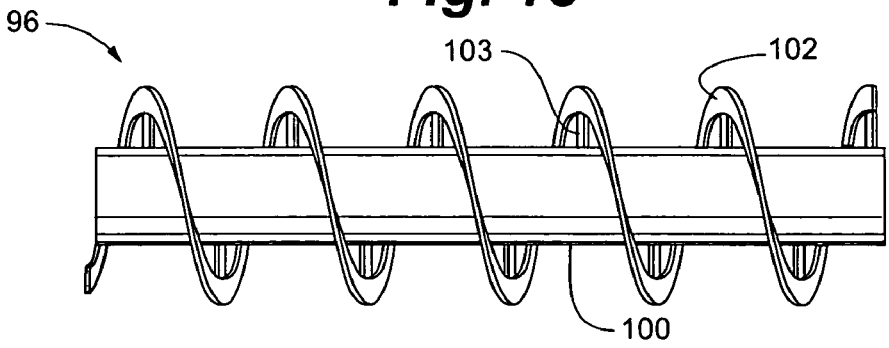
FIG. 13 is front elevational view of the auger.
Figure 14:
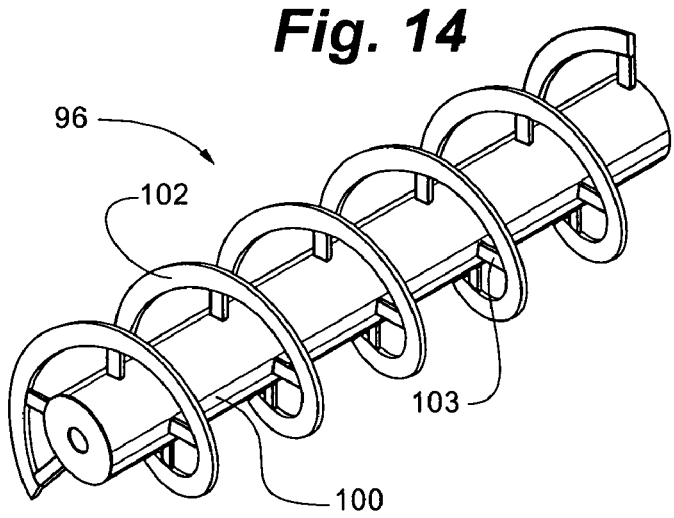
FIG. 14 is perspective view of the auger.
Figure 16:
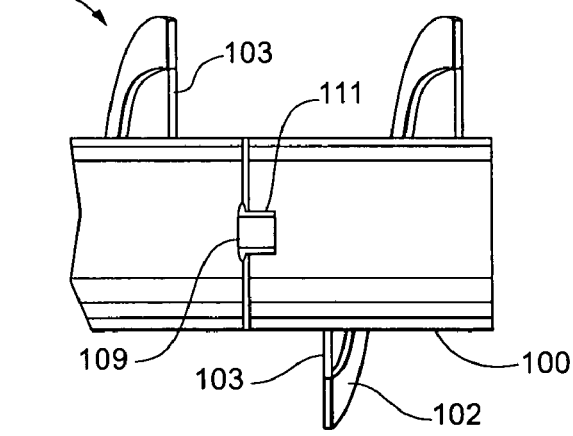
FIG. 16 is an elevational view of the left side margin of the auger.

As depicted in FIG. 16, a left end plate 109 is recessed from the left end margin of the hub 100. By recessing the end plate 109, a tubular space inside the hub 100 is formed in which the motor 106 is disposed. The inner margin of the short tubular hub 111 is splined and is matable to splines 117 on the drive shaft 119 of the motor 106, as depicted in FIG. 12. It should be noted that in a preferred embodiment, the motors 106, 126 are identical. The auger 96 is therefore both supported and rotationally driven at the left margin of the auger 96 by the motor 106.

Figure 9:
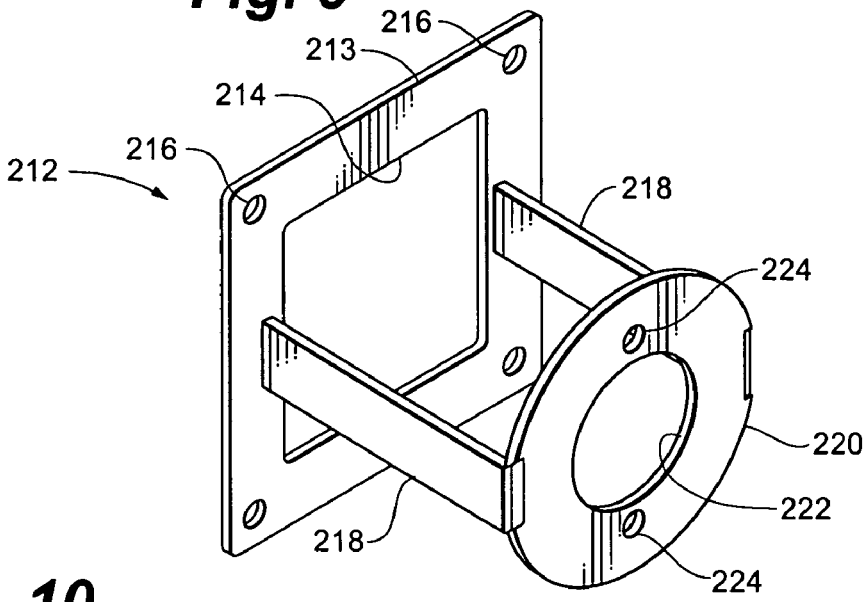
FIG. 9 is perspective view of a motor housing.

The hydraulic auger motor 106 is inserted through the opening 70 of the endplate 68 and fixedly coupled thereto by means of a motor mount 212, as depicted in FIG. 9. The description that follows also applies to a similar motor mount 212 used to secure the fan motor 126. The motor mount 212 has a generally rectangular end plate 213 that has an opening 214 defined therein that corresponds to the opening 70 in the respective end plates 68. Four bores 216 are in registry with the four bores 72 in the endplates 68. Bolts may be passed through the respective bores 216, 72 for securing the motor mount 212 to a respective end plate 68. A pair of supports that are orthogonally disposed relative to the end plate 213 are fixedly coupled to the end plate 213 and fixedly coupled to a spaced apart motor mounting plate 220. The motor mounting plate 220 has a centrally disposed bore defined therein that the drive shaft 119 of the motor 106, 126 can project through. A pair of bores 224 may be brought into registry with the bores 226 of the motor 106, 126 (FIG. 12), so that bolts passed therethrough may secure a respective motor 106, 126 to a respective motor mount 212.

Figure 10:
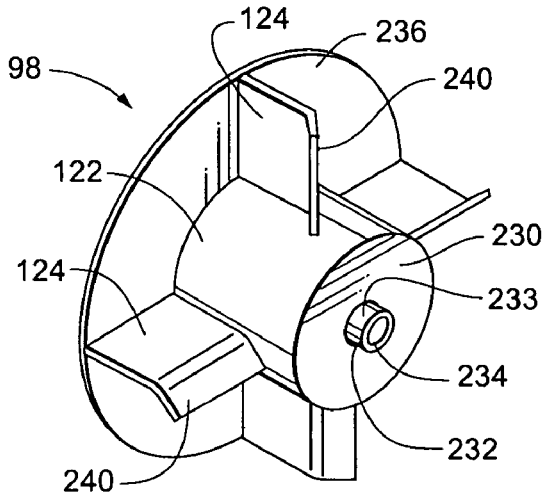
FIG. 10 is a perspective view of the fan.
Figure 11:
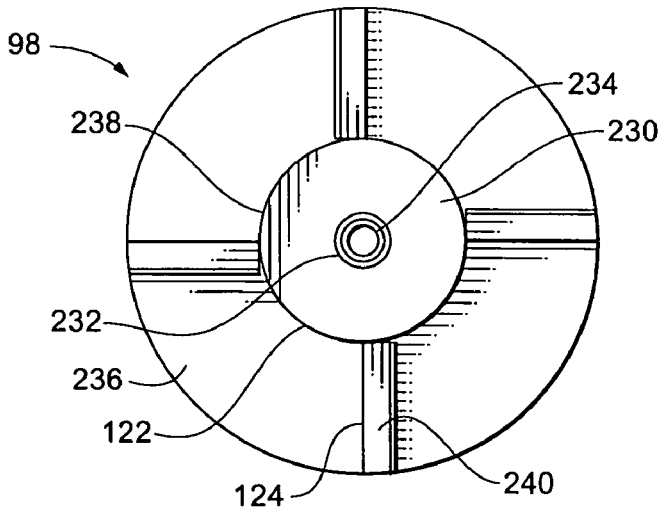
FIG. 11 is an elevational view of the fan.

Turning to the fan 98 as depicted in FIGS. 10 and 11, the fan 98 includes a relatively large diameter hub 122. The hub 122 is preferably formed of tubular steel and is preferably 8 inches in diameter, thereby defining a motor opening 125 therein. The hub 122 is closed at a leftward directed end by and end plate 230. A splined hub 232 is centrally disposed in the endplate 230. Splines 234 form an interior margin of the hub 232 and are compatible (matable) with the splines 117 of the motor 126. The hub 232 has a cylindrical outer margin 233. The hub 232 is preferably inserted into the space defined by the inner margin 113 of the hub 107 of the auger 96 to support the right end of the auger 96. A bearing or bushing (not shown) may be interposed between the margins 233 and 113. There is no central axle as such supporting both the fan 98 and the auger 96. The fan 98 and the auger 96 are mutually supportive, eliminating the need for such an axle.

The hub 122 is affixed to a relatively larger diameter end plate 236 disposed at a rightward directed end. The end plate 236 has a bore 238 defined therein that is substantially of the same diameter as the hub 122. The hub 122 is affixed to the end plate 236 proximate the margin of the bore 238.

A plurality of substantially rectangular blades 124 are included, each being affixed at an end margin to the hub 122 and at an orthogonal end margin to the end plate 236. The blades 124 are preferably flat and are disposed in a generally radial manner with respect to the hub 122 with a slight bend 240 at a distal end.

The hydraulic fan motor 126 is inserted through the opening 70 in the endplate 68 and affixed to the endplate 68 by the motor mount 212, as noted above. The hydraulic fan motor 126 is thereby disposed within the motor opening 124 defined in the hub 122 and coupled to a motor mount 212 as noted above. The splines 117 of the motor 126 may be mated to the splines 234 of the fan 98 for directly rotatably driving the fan 98. Other means of coupling the hydraulic fan motor 126 and the motor mount 212 may be employed, including, for example, a shaft and key, a square drive and a hex drive.

Turning now to the third subcomponent of the snow blower attachment 10, as depicted in FIGS. 1, 2, 4, and 5. The chute assembly 44 is disposed at the right hand side of the snow blower attachment 10 immediately above and in communication with the fan 98. The chute assembly 44 includes a rotatable turret 140, a chute 142, and a deflector 144. The turret 140 has a plate 146 that is affixed to a relatively short tube 147. The tube 147 is disposed in the outlet opening 58 of the chassis assembly 40, and the plate 146 rests on the top 54 adjacent to the outlet opening 58. It is understood that the turret 140 is readily rotatable relative to the chassis assembly 40. To effect such rotation, the plate 146 has a toothed edge that is formed on the outside margin of the plate 146 and extends around the plate 146 for in excessive of 270 degrees. Other means of rotation could as well be used including, for example, a chain or cable drive.

A motor 150 (either a hydraulic motor or a suitable electric motor) is mounted on the back 50 of the chassis assembly 40. The hydraulic configuration is be discussed below. The hydraulic motor 150 has a rotatable sprocket 152 that is engaged with the tooth edge 148. The hydraulic motor 150 is a bidirectional motor so that the chute assembly 44 can be rotated in either direction as desired. The chute assembly 44 is rotatable between a first position in which snow is being discharged leftwards substantially parallel with the longitudinal axis of the auger 96 to a second disposition in which the chute assembly 44 is discharging rearward, substantially along side the right side of the skid steer vehicle 20 in a direction that is substantially transverse to the longitudinal axis of the auger 96. Thus, the chute assembly 44 is rotatable through an arc of substantially 270°.

The turret 140 has a short upward directed tubular neck 154 that directs the chute 142 at an angle of between 30 and 85 degrees relative to the top 54 of the chassis assembly 40. The chute 142 is fixedly coupled to the neck 154 preferably at an angle of substantially 45 degrees relative to the top 54 of the chassis assembly 40. An alternative chute 142 could be employed when the discharged snow is to be loaded in a truck. Such chute 142 has an extended neck portion that is disposed at about 90 degrees relative to the top 54 of the chassis assembly 40. Such chute 142 has a deflector 144 that may be positioned at about 90 degrees relative to the longitudinal axis of the neck for ready discharge of the snow into the box of a truck.

The chute 142 has a pair of opposed, spaced apart flat sides 156 that are connected to a rounded back 158 that is designed to receive snow from the rounded facets 93. Preferably the rounded back 158 is formed by a series of relatively shallow angle adjacent tapering bends. The flat sides 156 define a front opening 160 of the chute 142.

The deflector (or cap) 144 is pivotally mounted to the chute 142. The deflector 144 includes a pair of opposed flat sides 162 coupled to a flat back 164, thereby defining a front opening 168 for the discharge of snow. The deflector 144 is affixed to the chute 142 by means of a pivot mount 170. The pivot mount 170 may be a bolt 171 passed through each of the flat sides 162 and through a respective flat side 156 of the chute 142.

A longitudinally extending actuator 172 is disposed alongside the chute 142 and is coupled at a first end by a chute mount 174 to the chute 142 and at a second end by a deflector mount 176 to the deflector 144. The longitudinally extending actuator 172 may be hydraulic or electric. The depicted embodiment is of a hydraulic cylinder 172. The hydraulic cylinder 172 is a double acting cylinder and provides that the angle of the deflector 144 relative to the chute 142 can be varied through an arc of about 90 degrees.

Figure 2:
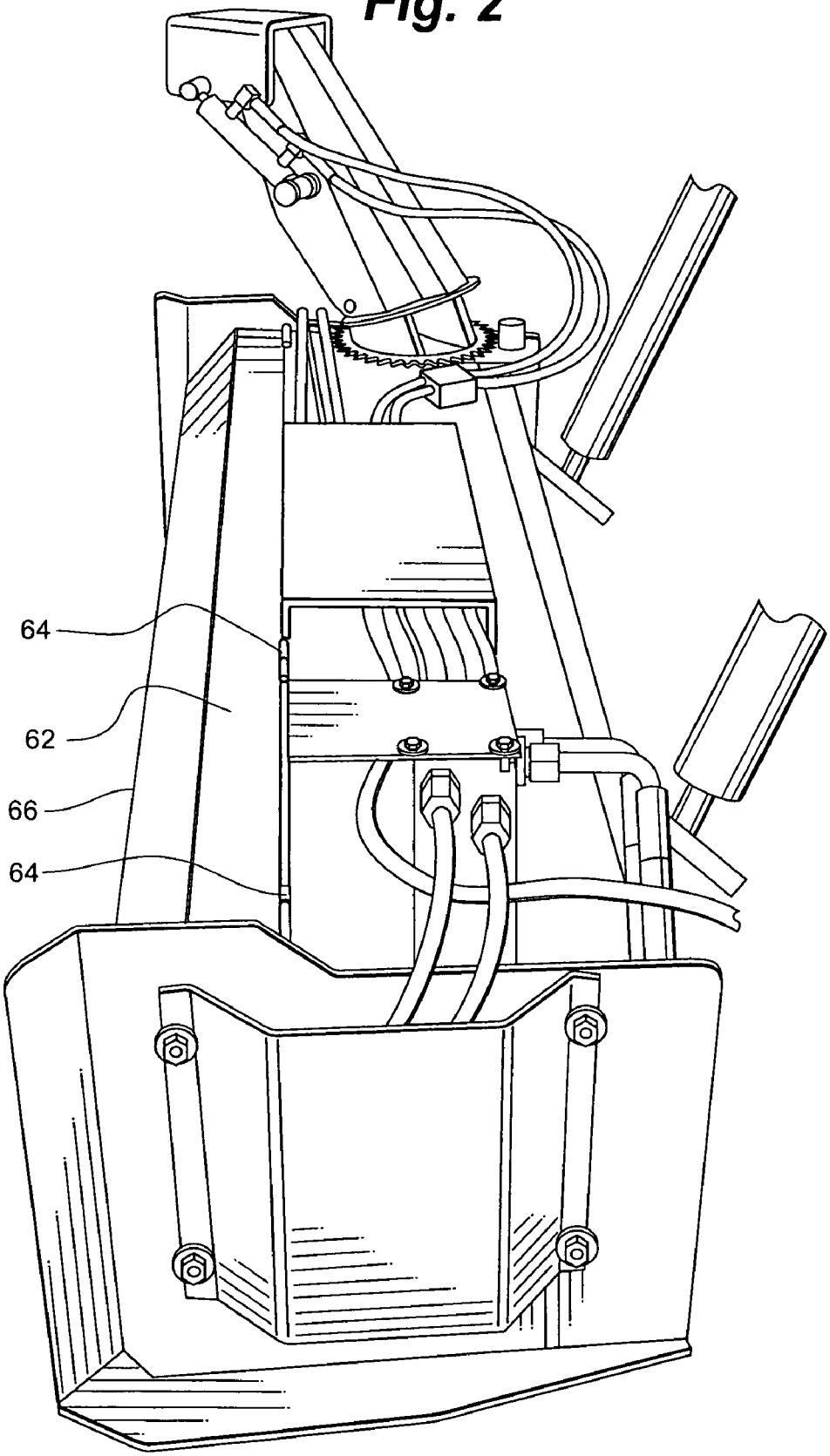
FIG. 2 is a left perspective view of the snow blower attachment mounted to a skid steer vehicle.
Figure 3:
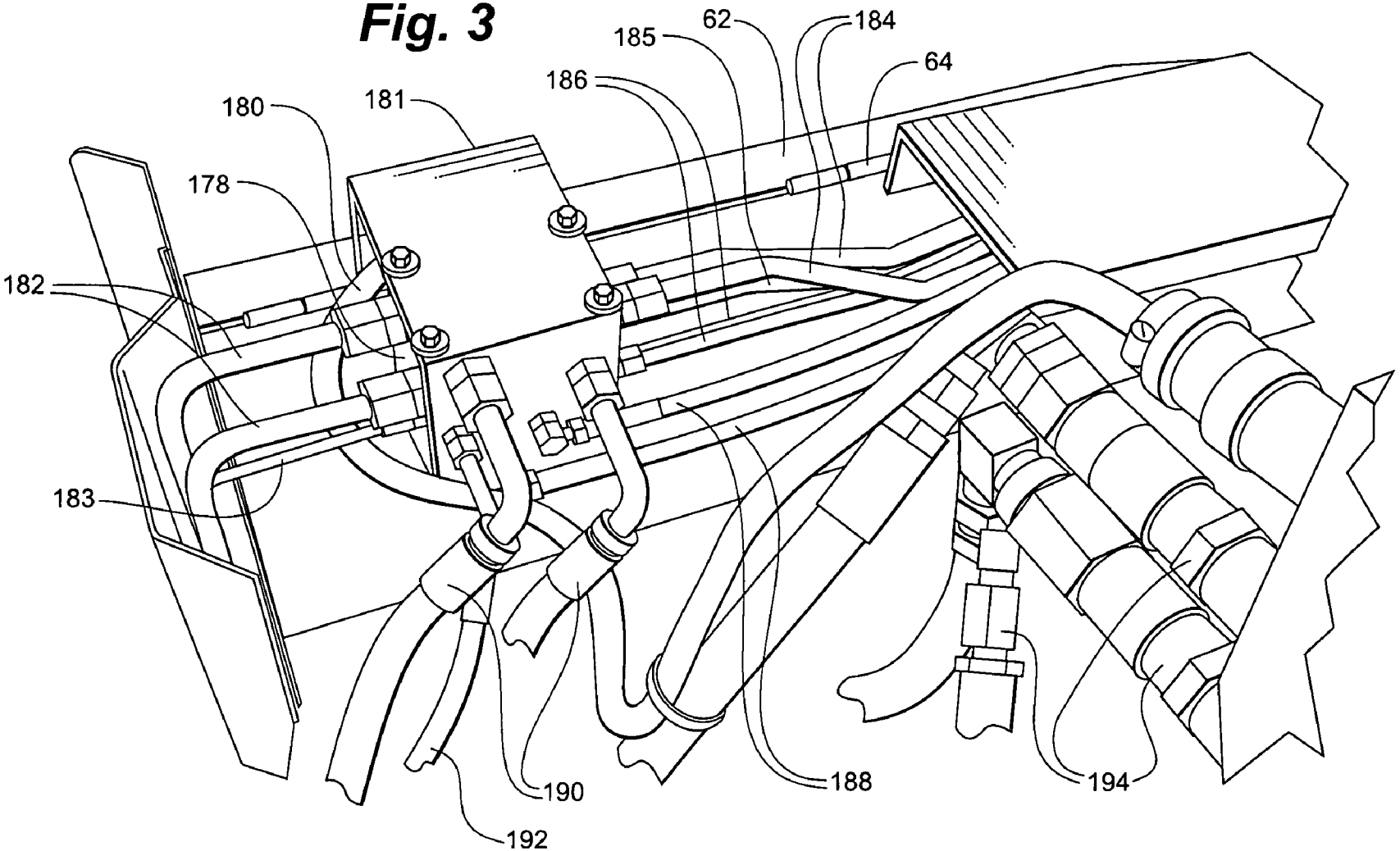
FIG. 3 is a front elevation view of the snow blower attachment mounted to a skid steer vehicle.

The fourth subcomponent of the snow blower attachment 10 is the hydraulic assembly 46, as depicted in FIGS. 1-3. The hydraulic assembly 46 includes a valve assembly 178 (depicted schematically in FIG. 17) and electric control 180 that is disposed beneath a cover 181 on the left hand side of the top 54 of the chassis assembly 40. A pair of auger motor tubes 182 emerges from the left hand side of the valve assembly 178 and is coupled to the auger motor 106. A third smaller tube emerges from the left hand side of the valve assembly 178 and is connected to the auger motor 106. This tube is the sump (or case) tube 183. Similarly, a pair of fan motor tubes 184 and a sump tube 185 emerges from the right hand side of the valve assembly 178 and is coupled to the fan motor 126. Additionally, a pair of turret actuation tubes 186 also emerges from the right hand side of the valve assembly 178 and is connected to the hydraulic motor 150.

A pair of deflector actuation hoses 188 emerges from the rear of the valve assembly 178 and is connected to the hydraulic cylinder 172. Three additional hoses emerge from the rear of the valve assembly 178. The two larger of the hoses are the input/return hoses 190. The third smaller hose is the sump return hose 192. Each of the two input/return hoses 190 and the return sump hose 192 are coupled to respective quick connectors 194 for mating of the hydraulic system of the skid steer vehicle 20.

Figure 17:
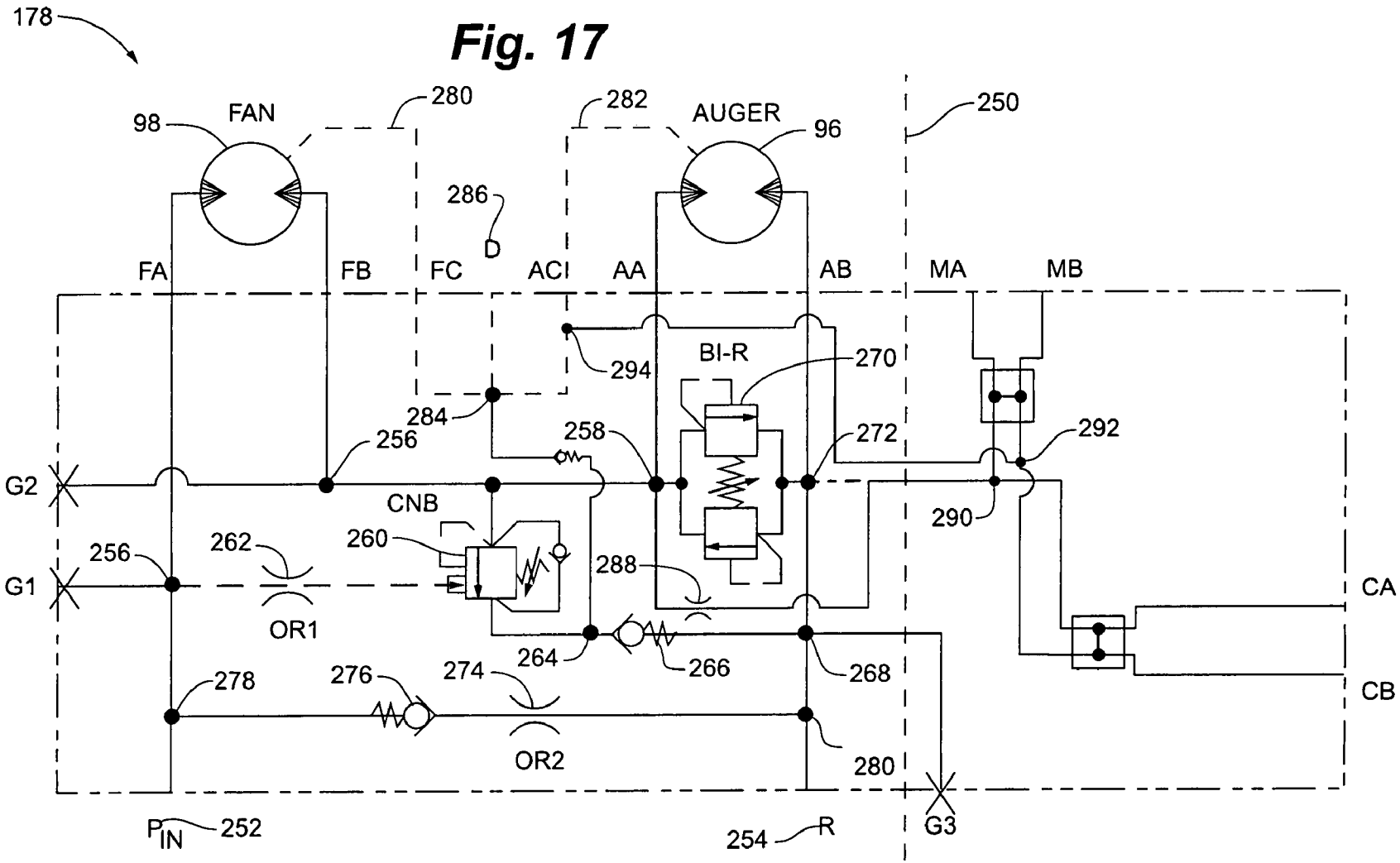
FIG. 17 is a schematic of the hydraulic assembly.

The valve assembly 178 is a multi use device that may be used to control a plurality of operations, especially where there is a feed function (auger in this specific case) and an operating function (fan in this specific case). Such operation may include a chipper/shredder operation, for example, where branches are automatically fed to a powered chipper. The valve assembly 178 as used in the present application is depicted in FIG. 17. Generally, each component that is supplied by the valve assembly 178 in the schematic includes an A and a B port. Thus, the fan A port is designated FA and the fan B port is designated FB. Likewise, the auger A port is designated AA and the auger B port is designated AB in the schematic. This notation is used for these and other components below. It should be noted that the operations right of the line 250 may as well be preformed as well by electric motors, as detailed above. In this case, this portion of the hydraulic schematic of FIG. 17 may be eliminated.

Proceeding to the description of the valve assembly 178, at the outset it should be noted that G1-G3 are extra taps that are used for pressure testing but presently play no part in the operation of the valve assembly 178. Hydraulic pressure in from the skid steer vehicle 20 is at $P_{in}$ 252 and return is at R 254. With a known skid steer vehicle 20, the pressure in is at approximately 3400 psi and the return pressure is about 200-400 psi. Pressure in travels to $P_{in}$ 252 from the skid steer vehicle 20 upward in the schematic to fan port FA, drives the fan 98, and exits the fan 98 at fan port FB. The fluid then travels downward to intersection 256, rightward to intersection 258 and upward to auger port AA. This fluid is at a pressure of about 600-800 psi in the present example. The hydraulic fluid drives the auger 96 and exits the auger 96 at auger port AB and returns downward to return R 254 and thence back to the skid steer vehicle 20 at about 200-400 psi.

It is known that the skid steer vehicle 20 has a relief valve that actuates at approximately something slightly greater than the 3400 psi maximum pressure in the present example. When this occurs, all hydraulic pressure generated by the skid steer vehicle 20 is dumped and the fan 98 and auger 96 receive hydraulic pressure, but no hydraulic flow. This causes the fan 98 and auger 96 to stop rotating and is wasteful of energy, both undesirable situations. To prevent the skid steer vehicle 20 from dumping pressure, it is important that the valve assembly 178 ensure that the pressure at which pressure relief occurs in the skid steer vehicle 20 is not approached. Accordingly, a counter balance valve (CNB) at 260 intersects the line from $P_{in}$ 252 to FA at intersection 256. The 3400 psi fluid is passed thru orifice OR1 at 262 to the CNB 260. The CNB 260 is adjustable and is usually set at about 500 psi less than the pressure at $P_{in}$ 252, in this case, about 2900 psi. Therefore, any pressure above 2900 psi at $P_{in}$ 252 is bled off and dumped to the return R 252. The hydraulic fluid that is bled off passes through intersection 264, check valve 266, and intersection to the return at 254. The fan 98 then receives a maximum of 2900 psi hydraulic fluid and the maximum pressure in the system is then also limited to 2900 psi, thereby minimizing the chance that the skid steer vehicle 20 relief pressure is ever reached.

Reverse operation of the fan 96 and auger 98 is also possible, in which case the input pressure is supplied at the return R 254 and $P_{in}$ 252 becomes the drain or return. Reverse operation is described in more detail below. At this point, it is sufficient to say that in reverse operation the high pressure (3400 psi, in this example) at R 254 is prevented from flowing to the CNB 260 by the check valve 266.

As noted above, when the auger 96 gets jammed, either with impacted snow or with a foreign object, it is desirable to reverse the flow of hydraulic fluid and to thereby reverse the rotational directions of the fan 98 and auger 96 to expel the impacted snow or eject a foreign object. Since the auger 96 may be in a nearly locked condition, it is desirable to minimize the hydraulic pressure that the auger 96 sees. A mere reversing of the hydraulic flow would port 3400 psi hydraulic fluid from R 254 to the auger port AB. With a locked auger 96, such pressure could damage the auger 96. To eliminate this possibility, a bi-directional relief (BI-R) valve 270 is interposed between the lines leading to the auger ports AA and AB at intersections 258 and 272 respectively. In this disposition, the BI-R 270 is available to provide pressure relief at a selected variable pressure (usually about 1000 psi) to the auger 96 by bleeding pressure from the intersection 272 to the intersection 258 and thence to return at $P_{in}$ 252. It should be noted that the BI-R 270 works similarly in the forward direction to bleed off pressure in the event of a stoppage of either or both the auger 96 and fan 98.

While the primary use of the BI-R 270 is during reverse operation, the BI-R 270 is also available to relieve pressure in the forward operation, especially as the auger 96 becomes jammed. Such jamming could cause a pressure spike were the system not protected by the BI-R. As the Auger 96 becomes jammed during forward operations, hydraulic pressure is bled off through the BI-R 270 by bleeding pressure from the intersection 258, through the BI-R 270 to intersection 272 and thence to the return at R 254.

In reverse operation, the orifice OR2 274 comes into play to limit the maximum pressure in the system. Hydraulic fluid is flowed through the orifice OR2 274 from the intersection 280 and through the overrunning check valve 276 to the intersection 278 and thence to return at $P_{in}$ 252. This permits the motion of the auger 96 to coast to a stop in the event that the hydraulic flow to the auger 96 is instantaneously shut off. Such pressure is typically limited to about 1000 psi to the auger 96 by the restricted flow through the OR2 274. The overrunning check valve 276 prevents flow through the above-described path during forward operations.

As noted above, most hydraulic motors have a sump drain or it may be referred to as a case drain. This drains away hydraulic leakage that virtually always occurs in the motor housing. The provision for this is at lines FC (fan case) 280 and AC (auger case) 282 that are joined at intersection 284 and then flow to drain D 286.

Turning to the components that are right of the line 250, there is both chute 142 rotation, having ports MA and MB, and deflector 144 (or cap) actuation, having ports CA and CB. Hydraulic fluid for actuation of chute rotation and deflector actuation is tapped off the input line to the auger 96 at intersection 258. Such fluid flows through orifice 288, further reducing the pressure, and thence to the ports MA and CA respectively through intersection 290. The volume and pressure of the hydraulic fluid necessary to provide such actuation is minimal in comparison to that required to operate the fan 98 and the auger 96. Accordingly, hydraulic fluid can be tapped of at the return line from the auger 92 at intersection 272 in order not to steal high pressure hydraulic fluid from either the fan 98 nor the auger 96. Waste oil pressure only is then used for driving chute 142 rotation and deflector 144 (or cap) actuation. Return flow is from the respective ports MB and CB to intersection 292 and thence to drain D 286 through intersections 294 and 284.

In operation, the snow blower attachment 10 is attached to the skid steer vehicle 20, either automatically from the cab 24 or manually outside the cab 24. The snow blower attachment 10 may be operated at any angle achievable by the lift arms 26 and the pivot actuators 28 of snow blower attachment 10. Accordingly, the snow blower attachment 10 may be elevated by the lift arms 28 and rotated so that the front opening 49 is facing downward. The snow blower attachment 10 may then be actuated in the forward direction so that both the auger 96 and the fan 98 are rotating. The snow blower attachment 10 may then driven high into a snow bank and gradually lowered to the ground by the arms 26, maintaining the downward orientation of the snow blower attachment 10. The chute assembly 44 may be rotated to direct the discharged snow generally parallel to the auger axis and, in this manner the snow bank may be shaved off.

Alternately, the snow blower attachment 10 may be rotated such that the front opening 49 is forward directed and the snow blower attachment 10 may elevated. The skid steer vehicle 320 may then advance the snow blower attachment 10 into a snow bank and blow an upper portion of snow from the bank. The skid steer vehicle 20 may then retreat, lower the snow blower attachment 10, and again advance into the snow bank. This may be repeated sequentially stepped down until the snow blower attachment 10 is lowered all the way to the ground and a significant portion of the bank reduced.

Additionally, the snow blower attachment 10 may be slightly rotated upward such that the leading edge of the snow blower attachment 10 is slightly elevated from the ground.

The skid steer vehicle 20 may then be advanced blowing snow, while ensuring that any foreign obstacles on the ground are passed over.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A two function snow blower attachment having a concentric axis fan and auger, the auger having the function of gathering and directing snow to the fan and the fan being a blower and having the function of ejecting the snow from the snow blower attachment, the fan and auger being independently powered by respective dedicated fan and auger motors and being axially operably coupled for independent rotation of the fan and auger, a hydraulic assembly having a first fluid coupling to the fan motor and a second fluid coupling to the auger motor for selective independent control of the respective fan motor and the auger motor, the hydraulic assembly having relief valve means for relieving hydraulic pressure to the auger via the second fluid coupling independent of hydraulic pressure to the fan via the first fluid coupling in the event of auger stoppage.

2. The snow blower attachment of claim 1 having mounts mounted to a snow blower attachment chassis, the mounts for effecting mounting directly to a vehicle.

3. The snow blower attachment of claim 1 having a discharge chute rotatably mounted on a chassis proximate a chassis end margin.

4. The snow blower attachment of claim 3, the chassis having a rounded lead-in portion leading to the discharge chute, the discharge chute having a round portion proximate the lead-in portion.

5. The snow blower attachment of claim 1, the auger having uni-directional fighting and having a tubular hub of substantial diameter.

6. The snow blower attachment of claim 1, the hydraulic assembly further for optionally independently rotationally powering a discharge chute and a deflector.

7. The snow blower attachment of claim 1, directions of rotation of the fan and auger being selectively reversible.

8. The snow blower attachment of claim 1, a snow blower attachment chassis having a ground engaging leading edge, the leading edge being hinged and deflectable responsive to being driven into an object.

9. The snow blower attachment of claim 1, a snow blower attachment chassis having a hinged cover disposed along a chassis top forward edge.

10. The snow blower attachment of claim 3, the discharge chute being rotatable through at least 270 degrees of rotation.

11. The snow blower attachment of claim 1, the hydraulic assembly having selectable maximum hydraulic pressure limiting means and selectable bi-directional hydraulic pressure limiting means operably fluidly coupled to the auger, effective for limiting pressure to the auger in both forward and reverse operations.

12. A two function snow blower, comprising:

a chassis assembly;

a discharge chute assembly rotatably disposed on the chassis assembly;

a hydraulic assembly disposed on the chassis assembly; and a fan/auger assembly having a concentric axis fan and auger operably coupled to the chassis assembly, the auger having the function of gathering and directing snow to the fan and the fan being a blower and having the function of ejecting the snow from the snow blower attachment, the fan and auger being independently powered by respective dedicated motors and being axially operably coupled for independent rotation of the fan and auger, the hydraulic assembly having relief valve means for relieving hydraulic pressure to the auger via the second fluid coupling independent of hydraulic pressure to the fan via the first fluid coupling in the event of auger stoppage.

13. The snow blower attachment of claim 12 having mounts mounted to the snow blower chassis assembly, the mounts for effecting mounting directly to a vehicle.

14. The snow blower attachment of claim 12 having the discharge chute assembly rotatably mounted on the chassis assembly proximate a chassis end margin.

15. The snow blower attachment of claim 12, the chassis assembly having a rounded lead-in portion leading to the discharge chute assembly, the discharge chute assembly having a round portion proximate the lead-in portion.

16. The snow blower attachment of claim 12, the auger having uni-directional fighting and having a tubular hub of substantial diameter.

17. The snow blower attachment of claim 12 the hydraulic assembly independently rotationally powering the discharge chute assembly and a deflector.

18. The snow blower attachment of claim 12, directions of rotation of the fan and auger being selectively, remotely reversible.

19. The snow blower attachment of claim 12, the snow blower attachment chassis assembly having a ground engaging leading edge, the leading edge being hinged and deflectable responsive to being driven into an object.

20. The snow blower attachment of claim 12, the snow blower attachment chassis assembly having a hinged cover disposed along a chassis top forward edge.

21. The snow blower attachment of claim 12 including the hydraulic assembly having selectable maximum hydraulic pressure limiting means and selectable bi-directional hydraulic pressure limiting means for limiting pressure to the auger in both forward and reverse operations.

22. A method of snow blower operation, comprising:

concentrically mounting fan and auger on an axis, independently powering the fan and auger by respective dedicated fan and auger motors, axially operably coupling the fan and the auger for independent rotation of the fan and auger, independently coupling a hydraulic assembly to the fan motor and to the auger motor for selective independent control of the respective fan motor and the auger motor, and providing the hydraulic assembly with relief valve means for relieving hydraulic pressure to the auger via the second fluid coupling independent of hydraulic pressure to the fan via the first fluid coupling in the event of auger stoppage.

* * * * *